US012104215B2

(12) United States Patent
Zhang et al.

(10) Patent No.: US 12,104,215 B2
(45) Date of Patent: Oct. 1, 2024

(54) HIGH-MAGNETIC-INDUCTION LOW-IRON-LOSS NON-ORIENTED SILICON STEEL SHEET AND MANUFACTURING METHOD THEREFOR

(71) Applicant: BAOSHAN IRON & STEEL CO., LTD., Shanghai (CN)

(72) Inventors: Feng Zhang, Shanghai (CN); Xianshi Fang, Shanghai (CN); Shishu Xie, Shanghai (CN); Zhenyu Zong, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 503 days.

(21) Appl. No.: 17/329,830

(22) Filed: May 25, 2021

(65) Prior Publication Data

US 2021/0277492 A1 Sep. 9, 2021

Related U.S. Application Data

(62) Division of application No. 16/304,377, filed on Nov. 26, 2018, now abandoned.

(51) Int. Cl.

| | |
|---|---|
| ***C21D 9/46*** | (2006.01) |
| ***C21D 8/12*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |

(52) U.S. Cl.

CPC ..... *C21D 8/1244* (2013.01); *C21D 9/46* (2013.01); *C22C 38/001* (2013.01); *C22C 38/02* (2013.01); *C22C 38/04* (2013.01); *C22C 38/06* (2013.01); *C22C 38/12* (2013.01); *C22C 38/14* (2013.01); *C21D 8/1205* (2013.01); *C21D 8/1222* (2013.01); *C21D 8/1233* (2013.01)

(58) Field of Classification Search

CPC ..... C22C 38/02

See application file for complete search history.

(56) References Cited

U.S. PATENT DOCUMENTS

| | | | |
|---|---|---|---|
| 2015/0013844 A1 | 1/2015 | Xie et al. | |
| 2019/0136336 A1 | 5/2019 | Zhang et al. | |

FOREIGN PATENT DOCUMENTS

| | | | | | |
|---|---|---|---|---|---|
| CN | 102453837 | A | | 5/2012 | |
| CN | 103014503 | A | | 4/2013 | |
| CN | 104399749 | A | | 3/2015 | |
| CN | 201610369192.2 | | | 5/2016 | |
| CN | 105925884 | A | | 9/2016 | |
| CN | 105936885 | A | | 9/2016 | |
| EP | 2832888 | A1 | | 4/2015 | |
| IN | 201827043524 | | | 10/2020 | |
| JP | 1139720 | | | 6/1989 | |
| JP | H01-139720 | A | | 6/1989 | |
| JP | H01139720 | | | 6/1989 | |
| JP | H03211258 | A | | 9/1991 | |
| JP | H05-140649 | A | * | 6/1993 | ..... B22D 11/22 |
| JP | 05331602 | A | | 12/1993 | |
| JP | H07-90376 | A | | 4/1995 | |
| JP | H07300619 | A | | 11/1995 | |
| JP | 08269532 | | | 10/1996 | |
| JP | 08269532 | A | | 10/1996 | |
| JP | H08269532 | A | | 10/1996 | |
| JP | H09-263909 | A | | 10/1997 | |
| JP | H10-25554 | A | | 1/1998 | |
| JP | 2000-219917 | | | 8/2000 | |
| JP | 2000219917 | A | | 8/2000 | |
| JP | 2004-68084 | A | | 3/2004 | |
| JP | 2015-515539 | A | | 5/2015 | |
| JP | 2018-560809 | | | 2/2018 | |
| KR | 10-0567239 | | | 3/2006 | |
| KR | 10-2018-7033432 | | | 2/2020 | |
| RU | 2398894 | C1 | | 10/2010 | |
| RU | 2534638 | C1 | | 12/2011 | |
| RU | 2527827 | C2 | | 10/2014 | |
| RU | 2018140788/02 | | | 7/2017 | |
| WO | 2017/206753 | A1 | | 12/2017 | |

OTHER PUBLICATIONS

English machine translation of JP H05-140649 A of Kumano (Year: 1993).*

* cited by examiner

*Primary Examiner* — Jophy S. Koshy

(74) *Attorney, Agent, or Firm* — Rothwell, Figg, Ernst & Manbeck, P.C.

(57) ABSTRACT

A high-magnetic-induction low-iron-loss non-oriented silicon steel sheet and a manufacturing method therefor. The chemical composition by mass percentages is: C≤0.005%, Si: 0.1%-1.6%, Mn: 0.1%-0.5%, P≤0.2%, S≤0.004%, Al≤0.003%, N≤0.005%, Nb≤0.004%, V≤0.004% and Ti≤0.003%, with the balance being Fe and inevitable impurities; and at the same time satisfies: 120≤[Mn]/[S]≤160, and [Nb]/93+[V]/51+[Ti]/48+[Al]/27≤[C]/12+[N]/14. After casting, the cooling rate in a cool-down process of casting slab is controlled, and a temperature controlling method is used to adjust the charging temperature of casting slab.

6 Claims, 2 Drawing Sheets

HIGH-MAGNETIC-INDUCTION LOW-IRON-LOSS NON-ORIENTED SILICON STEEL SHEET AND MANUFACTURING METHOD THEREFOR

CROSS-REFERENCE TO RELATED APPLICATIONS

The present application claims priority to and is a divisional of U.S. patent application Ser. No. 16/304,377 filed Nov. 26, 2018 and entitled "HIGH-MAGNETIC-INDUCTION LOW-IRON-LOSS NON-ORIENTED SILICON STEEL SHEET AND MANUFACTURING METHOD THEREFORE" which is hereby incorporated herein by reference in entirety for all purposes.

DESCRIPTION

Technical Field

The invention relates to a non-oriented silicon steel sheet. Specifically, the invention relates to a high-magnetic-induction low-iron-loss non-oriented silicon steel sheet and a manufacturing method therefor. Particularly, the invention relates to a high-magnetic-induction low-iron-loss non-oriented silicon steel sheet, which is obtained without normalization treatment or intermediate annealing in a bell furnace and has a relatively low manufacturing cost, and a manufacturing method therefor.

Background Art

In recent years, with the increasing demands for high efficiency, energy saving and environmental protection in consumer market, non-oriented silicon steel sheets for manufacturing of electric motors, compressors and EI iron core materials are required to have excellent electromagnetic properties (i.e. so-called low iron loss and high magnetic induction) under the premise of ensuring a competitive advantage in price, so as to meet the urgent needs of these electric products for high efficiency, energy saving and environmental protection.

Generally, the addition of high contents of Si and Al to steels can increase the electrical resistivity of the material, thereby reducing the iron loss of the material. For example, in Japanese Patent JP 2015515539 A, the Si content is 2.5% to 4.0%, and the Al content is 0.5% to 1.5%. Thus, the iron loss of the material rapidly decreases as the contents of Si and Al increase, the magnetic induction of the material however rapidly decreases and abnormal situations such as cold-rolled strip breakage are likely to occur. In order to improve the rollability of cold rolling, Chinese Patent No. CN 104399749 A discloses a method for preventing edge cracking and brittle fracture of a steel having a Si content of 3.5% or more, which improves the magnetic properties of the silicon steel sheet while preventing the steel sheet from edge cracking during a cold rolling process. However, even so, the rejection rate of brittle fracture is still 0.15% and the requirement on functional accuracy of the device is high in the above method. Moreover, in Chinese patent CN 103014503 A, in order to obtain a good magnetic induction of the material, 0.20% to 0.45% (Sn+Cu) was added to the steel and the texture morphology of the material was improved by grain-boundary segregation, thereby obtaining a good magnetic induction. However, Sn and Cu are expensive metals that greatly increase the manufacturing cost, and Cu is likely to cause quality defects on the surface of the strip.

In Japanese Patent No. H10-25554, the magnetic induction of the material is improved by increasing the ratio of Al/(Si+Al) under the premise that the total amount of Si and Al remains unchanged. However, as the Al content increases and the Si content decreases, the iron loss of the material deteriorates and the mechanical properties of the material decrease.

Nowadays, normalization treatment or intermediate annealing in a bell furnace is an effective method to improve the iron loss and magnetic induction of the material and is widely used in the production of high-efficiency, high-grade non-oriented silicon steel sheets, which effectively reduces the iron loss of the material and greatly increases the magnetic induction of the material. However, it introduces new production equipment, which greatly increases the manufacturing cost and extends the manufacturing and delivery cycle of the material, thereby bringing new troubles to the technical and quality managements in the production field.

Therefore, skilled artisans start the following studies: in the case that the chemical composition is relatively fixed, elements of strong deoxidation and desulfurization such as rare earth elements or calcium alloy are added to the steel to effectively remove or reduce non-metallic inclusions, thereby improving the electromagnetic properties of the material by improving the cleanliness of the steel; or a high-grade non-oriented electrical steel with high magnetic induction can also be obtained by rough rolling pass with large draft and by rough roll rolling and high temperature coiling; a high-magnetic-induction non-oriented silicon steel can also be obtained by using the hot roll leveling function and the normalizing annealing treatment.

SUMMARY OF THE INVENTION

The object of the invention is to provide a high-magnetic-induction low-iron-loss non-oriented silicon steel sheet and a manufacturing method therefor. The non-oriented silicon steel sheet has high magnetic induction and low iron loss, with no noble metal contained in its chemical composition. Also, the manufacturing process of the non-oriented silicon steel sheet does not require normalization treatment or intermediate annealing in a bell furnace, and has a relatively low manufacturing cost and stable production process.

In order to achieve the above object, the technical solutions of the present invention are as follows:

A high-magnetic-induction low-iron-loss non-oriented silicon steel sheet, wherein chemical composition thereof by mass percentages is: C≤0.005%, Si: 0.1%-1.6%, Mn: 0.1%-0.5%, P≤0.2%, S≤0.004%, Al≤0.003%, N≤0.005%, Nb≤0.004%, V≤0.004% and Ti≤0.003%, with the balance being Fe and inevitable impurities; and the above elements satisfy the following relationship at the same time: 120≤[Mn]/[S]≤160, and [Nb]/93+[V]/51+[Ti]/48+[Al]/27≤[C]/12+[N]/14.

Preferably, in the above chemical composition, 120≤[Mn]/[S]≤140.

Further, the non-oriented silicon steel sheet has the following electromagnetic properties:

when the Si content is 0.01%≤Si≤0.30%, corresponding to a steel grade of A-grade, magnetic induction $B_{50}$≥1.76 T, iron loss $P_{15/50}$≤7.00 W/kg;

when the Si content is 0.3%<Si≤0.80%, corresponding to a steel grade of B-grade, magnetic induction $B_{50}$≥1.75 T, iron loss $P_{15/50}$≤6.00 W/kg;

when the Si content is 0.8%<Si≤1.20%, corresponding to a steel grade of C-grade, magnetic induction $B_{50}$≥1.72 T, iron loss $P_{15/50}$≤4.00 W/kg;

when the Si content is 1.2%<Si≤1.600%, corresponding to a steel grade of D-grade, magnetic induction $B_{50}$≥1.70 T, iron loss $P_{15/50}$≤4.00 W/kg.

In the composition design of the steel of the invention:

C: C strongly hinders the growth of the grains of the finished product and easily forms fine precipitates in combination with Nb, V, Ti, etc., thereby causing an increase in loss and generation of magnetic aging. Therefore, the C content must be strictly controlled to 0.005% or less.

Si: Si can increase the electrical resistivity of matrix and effectively reduce the iron loss of the steel. When the Si content is more than 1.6%, the magnetic induction of the steel is remarkably reduced; and when it is less than 0.1%, the iron loss cannot be greatly reduced. Therefore, the Si content of the present invention is controlled to 0.1% to 1.6%.

Mn: Mn combines with S to form MnS, which effectively reduces its adverse effects on magnetic properties while improves the surface state of electrical steel and reduces hot brittleness. Therefore, it is necessary to add a Mn content of 0.1% or more. However, a Mn content of more than 0.5% or more easily breaks the recrystallization texture and greatly increases the manufacturing cost of the steel. Therefore, the Mn content of the present invention is controlled to 0.1% to 0.5%.

P: when the P content is more than 0.2%, a cold brittleness phenomenon tends to occur, which reduces the manufacturability of cold rolling. Therefore, the P content of the present invention is controlled to 0.2% or less.

S: when the S content is more than 0.004%, precipitates such as MnS are greatly increased, which strongly inhibits the growth of grains and deteriorates the magnetic properties of the steel. Therefore, the S content of the present invention is controlled to 0.004%0 or less.

Al: Al is an element that increases resistance and is used for deep deoxidation of electrical steel. When the Al content is more than 0.003%, the pouring in continuous casting is difficult and the magnetic induction is significantly reduced. Therefore, the Al content of the present invention is controlled to 0.003% or less.

N: when the N content is more than 0.005%, the precipitates formed by N and Nb, V, Ti, Al, and etc. are greatly increased, which strongly inhibits the growth of grains and deteriorates the magnetic properties of the steel. Therefore, the N content of the present invention is controlled to 0.005% or less.

Nb: when the Nb content is more than 0.004%, C and N inclusions of Nb are greatly increased, which strongly inhibits the growth of grains and deteriorates the magnetic properties of the steel. Therefore, the Nb content of the present invention is controlled to 0.0040% or less.

V: when the V content is more than 0.004%, C and N inclusions of V are greatly increased, which strongly inhibits the growth of grains and deteriorates the magnetic properties of the steel. Therefore, the V content of the present invention is controlled to 0.0040% or less.

Ti: when the Ti content is more than 0.003%, C and N inclusions of Ti are greatly increased, which strongly inhibits the growth of grains and deteriorates the magnetic properties of the steel. Therefore, the Ti content of the present invention is controlled to 0.003% or less.

A manufacturing method for the high-magnetic-induction low-iron-loss non-oriented silicon steel sheet according to the present invention, comprising the following steps:

1) Smelting and Casting

Conducting processes of converter smelting, RH refining and continuous casting based on the above chemical composition to form a casting slab, wherein in the continuous casting process, cooling rate during cooling process in which surface temperature of the casting slab is reduced from 1100° C. to 700° C. is controlled to 2.5° C./min to 20° C./min;

2) Heating

Heating the casting slab in a heating furnace, wherein charging temperature of the casting slab is controlled to 600° C. or less;

3) After hot rolling, pickling, cold rolling, final annealing and coating, a finished non-oriented silicon steel sheet is obtained.

Preferably, the charging temperature of the casting slab in step 2) is 300° C. or less.

Further, the non-oriented silicon steel sheet obtained in the present invention has the following electromagnetic properties:

when Si content is 0.01%≤Si≤0.30%, corresponding to a steel grade of A-grade, magnetic induction $B_{50}$≥1.76 T, iron loss $P_{15/50}$≤7.00 W/kg;

when Si content is 0.3%<Si≤0.80%, corresponding to a steel grade of B-grade, magnetic induction $B_{50}$≥1.75 T, iron loss $P_{15/50}$≤6.00 W/kg;

when Si content is 0.8%<Si≤1.20%, corresponding to a steel grade of C-grade, magnetic induction $B_{50}$≥1.72 T, iron loss $P_{15/50}$≤4.00 W/kg;

when Si content is 1.2%<Si≤1.600%, corresponding to a steel grade of D-grade, magnetic induction $B_{50}$≥1.70 T, iron loss $P_{15/50}$≤4.00 W/kg.

The innovations of the invention are as follows: more reasonable chemical compositions are achieved, and therefore significantly inhibit the precipitation and growth of MnS inclusions and carbides and nitrides of Nb, V, Ti, and Al, which have harmful side effects on the electromagnetic properties of the finished material. The details are as follows:

During the casting process, the temperature of the liquid steel gradually decreases, and the "[Mn][S] concentration product" in the solidification front gradually increase due to the segregations of Mn and S elements, and reaches or exceeds its equilibrium concentration, and then MnS inclusions begins to precipitate. MnS inclusions have great influences on the electromagnetic properties of finished materials due to their small size and large number. In the prior art, in order to eliminate the side effects of MnS as much as possible, strong deoxidizing elements or desulfurizing elements such as rare earth and calcium are added. Large particles of rare earth sulfide or calcium sulfide are formed instead of fine-sized MnS inclusions make use of the much greater ability of rare earth and calcium to combine with sulfur compared with Mn, and are floated removed using the buoyancy of liquid steel. However, this will greatly increase the manufacturing cost of steel making, and large-particle rare earth inclusions or calcium inclusions may easily block the nozzle, resulting in interruption of casting and occurrence of steel defects.

The present invention dynamically adjusts the addition amount of Mn based on the S content. FIG. 1 shows the relationship between [Mn]/[S] and magnetic induction $B_{50}$.

As can be seen from FIG. 1, as [Mn]/[S] increases, the magnetic induction $B_{50}$ first rises and then decreases rapidly. When the Mn/S is between 120 and 160, the magnetic induction $B_{50}$ is optimal. The invention controls [Mn]/[S] between 120 and 160 to ensure that MnS inclusions are precipitated as early as possible in the initial stage of solidification of liquid steel, which can provide temperature and time conditions for subsequent sufficient growth of MnS inclusions. The influence of MnS inclusions of 0.5 μm or more on the electromagnetic properties of the finished material is significantly weakened. At the same time, the present invention also strictly limits the temperature of the slab before charging the casting slab in the heating furnace, specifically, controlling the charging temperature of the casting slab to 600° C. or less, preferably to 300° C. or less, in order to use a lower casting slab temperature to further promote the growth of MnS during the heating process of the casting slab. As can be seen from FIG. 2, the magnetic induction $B_{50}$ decreases rapidly as the charging temperature of the casting slab increases. When the charging temperature is 600° C. or more, the magnetic induction $B_{50}$ remains at a low level. Therefore, from the viewpoint of practical production control, the charging temperature of the casting slab is kept at 600° C. or less, or an even lower level is preferable, preferably 300° C. or less.

In the present invention, the MnS inclusions formed by Mn and S elements can grow larger under the regulation of the above method, that is, the influence of MnS inclusions can be eliminated or attenuated. Moreover, Nb, V, Ti, and Al combine with C or N elements to form nanoscale Nb, V, Ti, Al carbon inclusions or nitrogen inclusions, the size of these inclusions is finer and mainly precipitates on the grain boundaries, which seriously impairs the electromagnetic properties of the finished material. Therefore, it is necessary to limit its precipitation as much as possible, that is, the precipitation time should be postponed and the amount of precipitation should be reduced.

Accordingly, on the one hand, regarding the requirements on composition design of the present invention, it is necessary to control the Nb, V, Ti, and Al contents within a suitable range and reduce them as much as possible, and control that [Nb]/93+[V]/51+[Ti]/48+[Al]/27≤[C]/12+[N]/14; on the other hand, in the refining process, controlling C, T, O and OB (oxygen blowing), vacuum degree and other conventional means can be used to achieve ultra-low C and N content. Thereby, the concentration product of C or N compounds formed by the combination of Nb, V, Ti, or Al element and C or N elements is greatly reduced, being equal to or below the equilibrium concentration product of precipitation, so that the amount of C or N compound formed by the combination of Nb, V, Ti, or Al element and C or N element is greatly reduced.

Meanwhile, in order to reduce the formation of C or N compound formed by the combination of Nb, V, Ti, or Al element and C or N element as much as possible, it is necessary to control the cooling rate during the cooling process in which the surface temperature of the casting slab is reduced from 1100° C. to 700° C. Since the dissolution and precipitation of trace elements of Nb, V, Al, and Ti in austenite and ferrite are greatly different, the cooling rate should be limited to 2.5-20° C./min. When the temperature is close to 1100° C., all trace elements of Nb, V, Al and Ti can be dissolved into the austenite; when the temperature is around 800° C., almost all of the carbides and nitrides of Nb, V, Al, and Ti precipitate; carbides have the fastest precipitation rate at a temperature of about 700° C.; as the temperature decreases, the precipitation rate of carbides decreases significantly. Based on the above, the cooling rate of the casting slab in the temperature range is increased as much as possible to reduce the residence time in the temperature range. As can be seen from FIG. 3, when the cooling rate is 2.5° C./min, the precipitates are mainly sulfide precipitates, and the precipitates have a large size (≥0.5 μm) and therefore have little influence on the magnetic properties of the finished product.

Regarding the effect of the controlling at present, an excessive cooling rate requires high equipment performance, so it is generally difficult to reach a cooling rate of above 20° C./min. Besides, a cooling rate exceeding 20° C./min has an adverse effect on the low-magnification quality of the casting slab. As can be seen from FIG. 4, when the cooling rate is 25° C./min, the precipitates are mainly nitride precipitates, having a small size (<0.5 μm) and therefore the magnetic properties of the finished product are affected. However, when the cooling rate is lower than 2.5° C./min, the cooling rate of the casting slab is too slow, which is disadvantageous for the control of the precipitation of carbides and nitrides of Nb, V, Al, and Ti, and more harmful inclusions are generated.

The purpose of controlling the [Mn]/[S] between 120-160 and [Nb]/93+[V]/51+[Ti]/48+[Al]/27≤[C]/12+[N]/14 in the chemical composition of the present invention is to strictly control the sulfides and nitrides which are harmful to magnetic properties. In the silicon steel manufacturing process design, in the continuous casting process, the cooling rate during the cooling process in which the surface temperature of the casting slab is reduced from 1100° C. to 700° C. is controlled to 2.5-20° C./min; and the charging temperature when heating the casting slab is controlled to 600° C. or less, which is based on the metallurgical principle and is optimized by the "formation mechanism" of the precipitate rather than the conventional "control mechanism".

Beneficial Effects of the Invention

The invention optimizes the chemical composition design and obtains a suitable Mn/S ratio by adjusting the manganese and sulfur contents. After the smelting, the Nb, V, Ti, and Al contents are controlled and meet the design requirements. In the casting process, the cooling rate during the cooling process in which the surface temperature of the casting slab is reduced from 1100° C. to 700° C. is controlled. After the casting of the liquid steel, the charging temperature of the casting slab is adjusted by temperature controlling method. The obtained non-oriented silicon steel sheet has high magnetic induction and low iron loss. The present invention effectively realizes the stable production of high-magnetic-induction low-iron-loss non-oriented silicon steel sheets.

The manufacturing process of the present invention does not require normalization treatment or intermediate annealing in a bell furnace, and has the characteristics of low cost, simple operation, easy realization and low production difficulty. At the same time, the manufacturing process is stable, and the produced finished silicon steel sheet has excellent electromagnetic performances.

DETAILED DESCRIPTION

Figure 1:
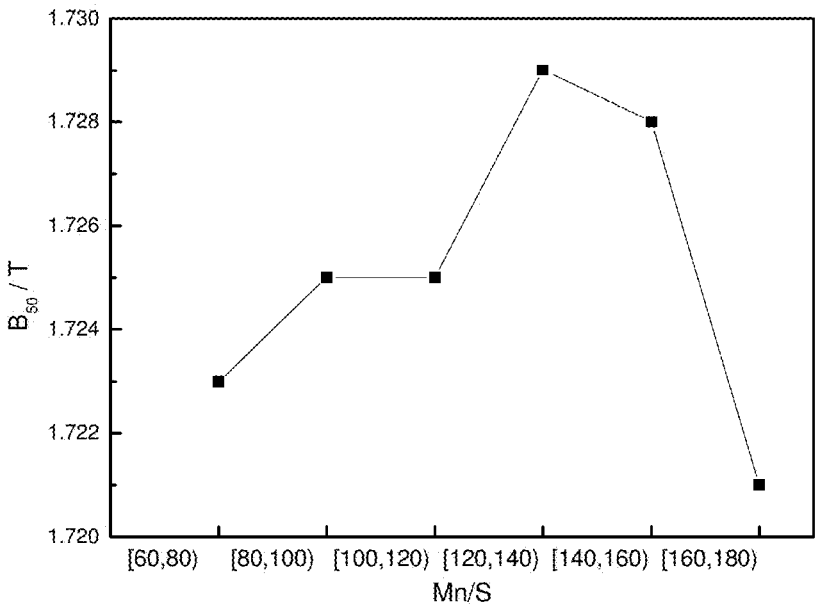
FIG. 1 shows the relationship between [Mn]/[S] and magnetic induction $B_{50}$ of the present invention.
Figure 2:
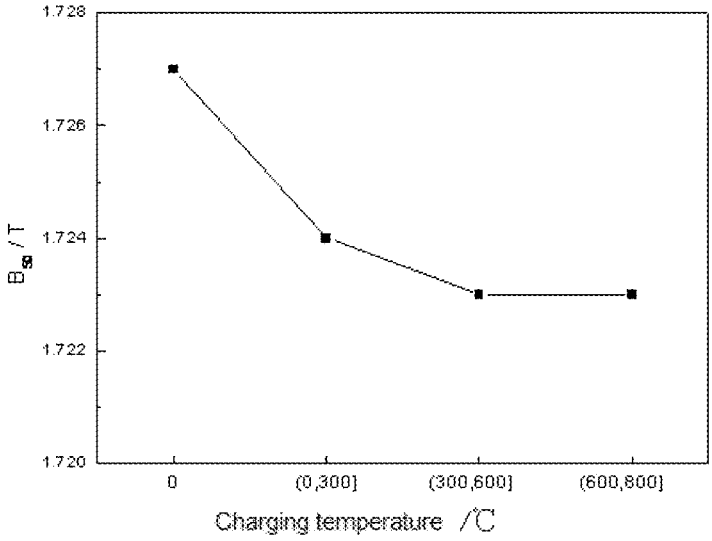
FIG. 2 shows the relationship between the charging temperature of the casting slab and the magnetic induction $B_{50}$ of the present invention.
Figure 3:
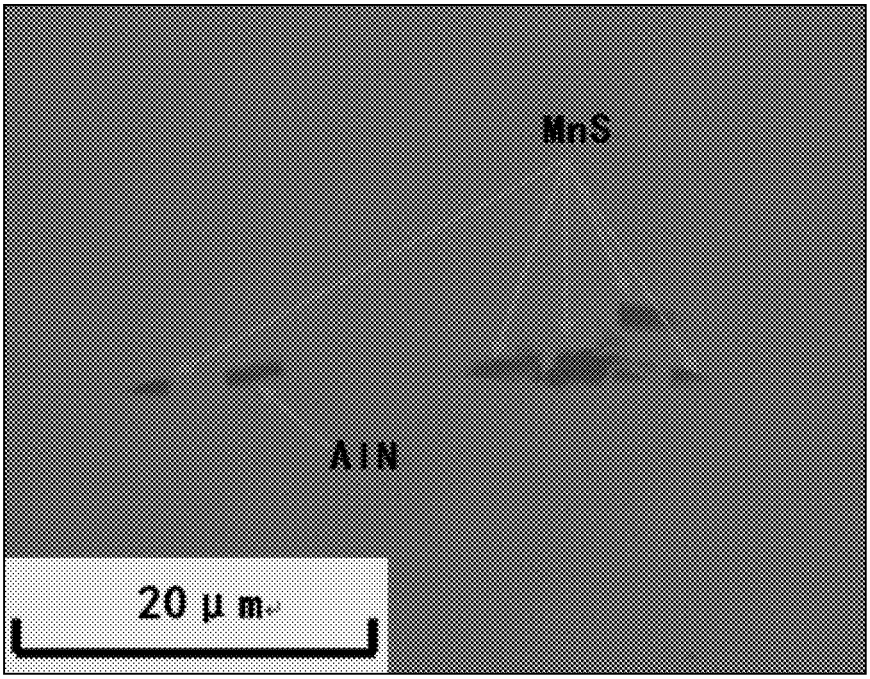
FIG. 3 is a graph showing the type and size of precipitates when the cooling rate during the cooling process in which the surface temperature of the casting slab is reduced from 1100° C. to 700° C. is controlled to 2.5° C./min.
Figure 4:
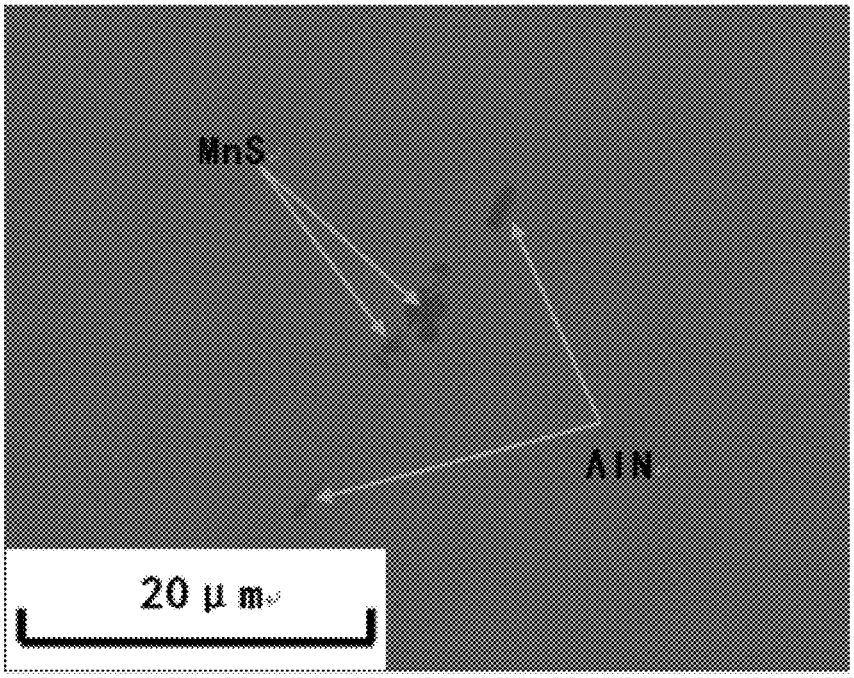
FIG. 4 is a graph showing the type and size of precipitates when the cooling rate during the cooling process in which the surface temperature of the casting slab is reduced from 1100° C. to 700° C. is controlled to 25° C./min.

The invention will be further illustrated by the following Examples.

Table 1 shows compositions of silicon steel sheets of Examples and Comparative Examples of the present invention. Table 2 shows the process design and electromagnetic properties of Examples and Comparative Examples of the present invention.

EXAMPLES liquid iron and steel scrap are proportioned according to the chemical composition ratios in Table 1. After smelting in a 300-ton converter, decarburization, deoxidation and alloying are carried out by RH refining; the Mn content is dynamically adjusted according to the S content in the steel to obtain the optimum ratio of [Mn]/[S], and the C, N, Nb, V, Ti, and Al contents are controlled to meet the design requirements; after the liquid steel is cast by continuous casting, a casting slab of 170 mm to 250 mm thick and 800 mm to 1400 mm wide is obtained; after the casting, the cooling rate during the cooling process in which the surface temperature of the casting slab is reduced from 1100° C. to 700° C. is controlled to 2.5-20° C./min; then, the charging temperature of the casting slab is adjusted to 600° C. or less, preferably 300° C. or less by a temperature controlling method; then, the casting slab is sequentially subjected to hot rolling, pickling, cold rolling, annealing and coating to obtain a final product. The process parameters and electromagnetic properties are shown in Table 2.

The explanation of the data in Table 1 and Table 2 is as follows:

In Table 1, the Si content is in the range of 0.1% to 1.6%. The steel can be divided into four types according to Si contents: a Si content of 0.11% to 0.30%, a Si content of 0.30% to 0.80% (does not comprise 0.30%), a Si content of 0.80% to 1.20% (does not comprise 0.80%), a Si content of 1.20% to 1.60% (does not comprise 1.20%), marked as A-grade, B-grade, C-grade, and D-grade respectively. Steels of the same grade having different Si content will have magnetic properties of the same type.

In the present invention, all A-grade steels (Examples 1-3) satisfy electromagnetic properties of a magnetic induction $B_{50} \geq 1.76$ T and an iron loss $P_{15/50} \leq 6.50$ W/kg; all B-grade steels (Examples 4-6) satisfy electromagnetic properties of a magnetic induction $B_{50} \geq 1.75$ T and an iron loss $P_{15/50} \leq 5.40$ W/kg; all C-grade steels (Examples 7-9) satisfy electromagnetic properties of a magnetic induction $B_{50} \geq 1.72$ T and an iron loss $P_{15/50} \leq 4.00$ W/kg; all D-grade steels (Examples 10-11) satisfy the electromagnetic properties of a magnetic induction $B_{50} \geq 1.70$ T and an iron loss $P_{15/50} \leq 3.80$ W/kg.

In Comparative Example 1, [Mn]/[S] is lower than the control requirement of 120. In Comparative Example 2, ([C]/12+[N]/14)−([Nb]/93+[V]/51+[Ti]/48+[Al]/27) is less than 0. In Comparative Example 3, neither [Mn]/[S] nor ([C]/12+[N]/14)−([Nb]/93+[V]/51+[Ti]/48+[Al]/27) satisfies the control requirements. In Comparative Example 4, the charging temperature of the slab is more than 600° C. In Comparative Example 5, the cooling rate of the casting slab is more than 20° C./min. In Comparative Example 6, [Mn]/[S], ([C]/12+[N]/14)−([Nb]/93+[V]/51+[Ti]/48+[Al]/27) and charging temperature of the casting slab does not satisfy the control requirements. In Comparative Example 7, the cooling rate of the casting slab is less than 2.5° C./min and the charging temperature of the casting slab is more than 600° C. In other words, as long as one condition does not satisfy the design requirements of the present invention, the electromagnetic properties of the corresponding steel are not good.

It can be seen that for the same grade, the non-oriented silicon steel sheet of the present invention has a higher magnetic induction and a lower iron loss.

TABLE 1

Unit: mass percentage

| | | C | Si | Mn | P | S | Nb | V | Al | Ti | N | E | F |
|---|---|---|---|---|---|---|---|---|---|---|---|---|---|
| A1 | Comparative Example 1 | 0.0041 | 0.11 | 0.24 | 0.08 | 0.0032 | 0.0008 | 0.0011 | 0.0018 | 0.0006 | 0.0015 | 75 | $3.39 \times 10^{-4}$ |
| A2 | Comparative Example 2 | 0.0008 | 0.16 | 0.27 | 0.09 | 0.0021 | 0.0013 | 0.0021 | 0.0032 | 0.0002 | 0.0011 | 129 | $-3.26 \times 10^{-5}$ |
| B1 | Comparative Example 3 | 0.0018 | 0.38 | 0.48 | 0.12 | 0.0011 | 0.0039 | 0.0036 | 0.0021 | 0.0028 | 0.0012 | 436 | $-1.29 \times 10^{-5}$ |
| B2 | Comparative Example 4 | 0.0032 | 0.45 | 0.36 | 0.11 | 0.0029 | 0.0026 | 0.0019 | 0.0007 | 0.0004 | 0.0043 | 124 | $4.74 \times 10^{-4}$ |
| C1 | Comparative Example 5 | 0.0019 | 0.94 | 0.14 | 0.06 | 0.0009 | 0.0011 | 0.0016 | 0.0016 | 0.0019 | 0.0029 | 156 | $2.23 \times 10^{-4}$ |
| D1 | Comparative Example 6 | 0.0014 | 1.53 | 0.18 | 0.02 | 0.0034 | 0.0028 | 0.0025 | 0.0018 | 0.0024 | 0.0008 | 53 | $-2.20 \times 10^{-5}$ |
| D2 | Comparative Example 7 | 0.0041 | 1.53 | 0.32 | 0.02 | 0.0021 | 0.0007 | 0.0012 | 0.0011 | 0.0009 | 0.0031 | 152 | $4.73 \times 10^{-4}$ |
| A3 | Example 1 | 0.0013 | 0.12 | 0.34 | 0.09 | 0.0024 | 0.0004 | 0.0008 | 0.0011 | 0.0006 | 0.0048 | 142 | $3.78 \times 10^{-4}$ |
| A4 | Example 2 | 0.0007 | 0.19 | 0.27 | 0.09 | 0.0018 | 0.0009 | 0.0021 | 0.0007 | 0.0007 | 0.0009 | 150 | $3.13 \times 10^{-5}$ |
| A5 | Example 3 | 0.0034 | 0.14 | 0.12 | 0.07 | 0.0008 | 0.0004 | 0.0008 | 0.0011 | 0.0006 | 0.0021 | 150 | $3.60 \times 10^{-4}$ |
| B3 | Example 4 | 0.0039 | 0.38 | 0.47 | 0.12 | 0.0031 | 0.0006 | 0.0008 | 0.0021 | 0.0017 | 0.0022 | 152 | $3.47 \times 10^{-4}$ |
| B4 | Example 5 | 0.0027 | 0.53 | 0.39 | 0.1 | 0.0032 | 0.0038 | 0.0006 | 0.0006 | 0.0004 | 0.0012 | 122 | $2.28 \times 10^{-4}$ |
| B5 | Example 6 | 0.0018 | 0.44 | 0.27 | 0.12 | 0.0018 | 0.0006 | 0.0008 | 0.0021 | 0.0004 | 0.0029 | 150 | $2.49 \times 10^{-4}$ |
| C2 | Example 7 | 0.0022 | 0.94 | 0.19 | 0.06 | 0.0015 | 0.0011 | 0.0014 | 0.0011 | 0.0008 | 0.0019 | 127 | $2.22 \times 10^{-4}$ |
| C3 | Example 8 | 0.0028 | 0.98 | 0.43 | 0.06 | 0.0035 | 0.0008 | 0.0006 | 0.0028 | 0.0002 | 0.0039 | 123 | $3.84 \times 10^{-4}$ |
| C4 | Example 9 | 0.0019 | 1.07 | 0.18 | 0.06 | 0.0012 | 0.0011 | 0.0037 | 0.0011 | 0.0008 | 0.0008 | 150 | $7.37 \times 10^{-5}$ |
| D3 | Example 10 | 0.0035 | 1.47 | 0.36 | 0.02 | 0.0023 | 0.0007 | 0.0011 | 0.0019 | 0.0011 | 0.0032 | 157 | $3.98 \times 10^{-4}$ |
| D4 | Example 11 | 0.0044 | 1.58 | 0.49 | 0.02 | 0.0034 | 0.0007 | 0.0011 | 0.0019 | 0.0011 | 0.0036 | 144 | $5.01 \times 10^{-4}$ |

Remarks:

E = [Mn]/[S], F = ([C])/12 + [N]/14 − ([Nb]/93 + [V]/51 + [Ti]/48 + [Al]/27)

TABLE 2

| | | Cooling rate of casting slab (° C./min) | Charging temperature of casting slab (° C.) | Magnetic induction $B_{50}$ (T) | Iron loss $P_{15/50}$ (W/kg) |
|---|---|---|---|---|---|
| A1 | Comparative Example 1 | 3.2 | 583 | 1.748 | 7.18 |
| A2 | Comparative Example 2 | 8.9 | 427 | 1.742 | 6.95 |
| B1 | Comparative Example 3 | 22.5 | 284 | 1.734 | 5.89 |
| B2 | Comparative Example 4 | 18.9 | 615 | 1.738 | 5.91 |
| C1 | Comparative Example 5 | 21.2 | 397 | 1.711 | 4.17 |
| D1 | Comparative Example 6 | 14.8 | 735 | 1.694 | 3.98 |
| D2 | Comparative Example 7 | 1.8 | 608 | 1.697 | 4.15 |
| A3 | Example 1 | 2.9 | 284 | 1.771 | 5.98 |
| A4 | Example 2 | 8.3 | 229 | 1.762 | 6.12 |
| A5 | Example 3 | 11.3 | 325 | 1.765 | 6.24 |
| B3 | Example 4 | 3.7 | 164 | 1.758 | 4.96 |
| B4 | Example 5 | 6.3 | 211 | 1.752 | 5.07 |
| B5 | Example 6 | 8.2 | 381 | 1.754 | 5.22 |
| C2 | Example 7 | 18.1 | 495 | 1.729 | 3.75 |
| C3 | Example 8 | 12.2 | 584 | 1.738 | 3.81 |
| C4 | Example 9 | 15.8 | 429 | 1.734 | 3.92 |
| D3 | Example 10 | 10.9 | 557 | 1.711 | 3.72 |
| D4 | Example 11 | 8.7 | 593 | 1.720 | 3.64 |

We claim:

1. A manufacturing method for a non-oriented silicon steel sheet, the method comprising:

smelting, refining and continuous casting a chemical composition to form a casting slab, wherein the chemical composition comprises mass percentages of: C≤0.005%, Si: 0.1%-1.6%, Mn: 0.1%-0.5%, P≤0.2%, S≤0.004%, Al≤0.003%, N≤0.005%, Nb≤0.004%, V≤0.004% and Ti≤0.003%, with the remaining balance being Fe and impurities;

wherein the chemical composition satisfies 120≤[Mn]/[S]≤160 and [Nb]/93+[V]/51+[Ti]/48+[Al]/27≤[C]/12+[N]/14, wherein [Mn], [S], [Nb], [V], [Ti], [Al], [C] and [N] represent the contents of Mn, S, Nb, V, Ti, Al, C and N, respectively, in mass percent;

after the continuous casting, reducing a surface temperature of the casting slab from 1100° C. to 700° C. at a cooling rate within a range from 2.5° C./min to 20° C./min;

heating the casting slab in a heating furnace, wherein a charging temperature of the casting slab is controlled to 600° C. or less; and subjecting the casting slab to hot rolling, pickling, cold rolling, final annealing, and coating to obtain the non-oriented silicon steel sheet.

2. The manufacturing method according to claim 1, wherein the charging temperature of the casting slab is 300° C. or less.

3. The manufacturing method according to claim 2, wherein the non-oriented silicon steel sheet has the following electromagnetic properties:

for Si content of 0.1%≤Si≤0.30%, the non-oriented silicon steel sheet has magnetic induction $B_{50}$≥1.76 T and iron loss $P_{15/50}$≤7.00 W/kg;

for Si content of 0.3%<Si≤0.80%, the non-oriented silicon steel sheet has magnetic induction $B_{50}$≥1.75 T and iron loss $P_{15/50}$≤6.00 W/kg;

for Si content of 0.8%<Si≤1.20%, the non-oriented silicon steel sheet has magnetic induction $B_{50}$≥1.72 T and iron loss $P_{15/50}$≤4.00 W/kg;

for Si content of 1.2%<Si≤1.60%, the non-oriented silicon steel sheet has magnetic induction $B_{50}$≥1.70 T and iron loss $P_{15/50}$≤4.00 W/kg.

4. The manufacturing method according to claim 2, wherein the chemical composition comprises a ratio of [Mn]/[S] that is between 120≤[Mn]/[S]≤140, wherein [Mn] and [S] represent the contents of Mn and S, respectively, in mass percent.

5. The manufacturing method according to claim 1, wherein the non-oriented silicon steel sheet has the following electromagnetic properties:

for Si content of 0.1%≤Si≤0.30%, the non-oriented silicon steel sheet has magnetic induction $B_{50}$≥1.76 T and iron loss $P_{15/50}$≤7.00 W/kg;

for Si content of 0.3%<Si≤0.80%, the non-oriented silicon steel sheet has magnetic induction $B_{50}$≥1.75 T and iron loss $P_{15/50}$≤6.00 W/kg;

for Si content of 0.8%<Si≤1.20%, the non-oriented silicon steel sheet has magnetic induction $B_{50}$≥1.72 T and iron loss $P_{15/50}$≤4.00 W/kg;

for Si content of 1.2%<Si≤1.60%, the non-oriented silicon steel sheet has magnetic induction $B_{50}$≥1.70 T and iron loss $P_{15/50}$≤4.00 W/kg.

6. The manufacturing method according to claim 1, wherein the chemical composition comprises a ratio of [Mn]/[S] that is between 120≤[Mn]/[S]≤140, wherein [Mn] and [S] represent the contents of Mn and S, respectively, in mass percent.

* * * * *